United States Patent [19]

Hasty et al.

[11] Patent Number: 4,865,015

[45] Date of Patent: Sep. 12, 1989

[54] HEARTH GUARD

[76] Inventors: Kathy M. Hasty, 9522 Providence Rd., S., Waxhaw, N.C. 28173; Mary K. McKenzie, Helen Dr., Mineral Springs, N.C. 28108

[21] Appl. No.: 263,682

[22] Filed: Oct. 27, 1988

[51] Int. Cl.[4] ..... F24B 13/02; B32B 3/06

[52] U.S. Cl. ..... 126/500; 5/493; 428/74; 428/99

[58] Field of Search ..... 126/500; 52/3, 515, 52/DIG. 13; 5/100, 512, 493; 428/74, 99, 100

[56] References Cited

U.S. PATENT DOCUMENTS

| | | | |
|---|---|---|---|
| 2,606,755 | 8/1952 | Samuels | 267/1 |
| 4,117,782 | 10/1978 | Cahill | 108/27 |
| 4,153,230 | 5/1979 | Gracia | 248/345.1 |
| 4,787,366 | 11/1988 | Bell | 126/500 |

*Primary Examiner*—Larry Jones

*Attorney, Agent, or Firm*—Ralph H. Dougherty

[57] ABSTRACT

The hearth guard includes a plurality of flameproof cotton batting sheets. A rectangular flameproof cloth encases the plurality of flameproof cotton batting sheets. Elastic bands are encased within and affixed inside the cover, situated at and parallel to the top and bottom of the cover, within openings defined by at least one seam. The elastic bands allow for fitting the cover to the hearth. Drawstrings are inserted longitudinally through the top and bottom of the cover, within openings defined by at least one seam. The drawstrings allow for securing the cover to the hearth. The elastic bands and drawstrings may use the same opening or may have separate openings. If separate openings are used, the openings may share a common seam. At least one pair of tie strings is used to secure the cover to an upstanding side. For each pair of tie strings, one tie string is affixed to the edge of the cover, while the remaining tie string is affixed to the opposite edge of the cover. Each tie string extends outwardly from the edge of the cover. Connecting mechanisms other than tie strings can also be used to attach the cover to the anchoring mechanisms. Hooks are fastened or embedded into the upstanding sides for securing the drawstrings and the connecting mechanisms thereto. Anchoring mechanisms other than hooks can also be used to secure the hearth guard.

11 Claims, 2 Drawing Sheets

HEARTH GUARD

BACKGROUND OF THE INVENTION

1. Field of the Invention

The present invention generally relates to safety articles and, more particularly, is concerned with a guard for protecting against injuries suffered as the result of falling onto the edge of a hearth.

2. Description of the Prior Art

People of all ages are susceptible to bumps, bruises, cuts, and scrapes of various degrees, often the result of some sort of fall. Children are particularly susceptible. If the fall is onto an edged surface, the injury can be severe. A raised hearth, which is a raised refractory floor situated in front of a fireplace, exhibits such an edged surface.

The applicants are aware of the following U. S. Patents concerning safety articles related to fireplaces or used to protect against the dangers of falling onto an edged surface.

| U.S. Pat. No. | Issue Date | Inventor | Title |
|---|---|---|---|
| 640,700 | 01/02/00 | Reece | FENDER |
| 2,430,241 | 11/04/47 | Nicholas | COMBINATION OF TELEPHONE STAND, CHAIR, AND SCREEN |
| 4,117,782 | 10/03/78 | Cahill | GUARD FOR PREVENTING HUMAN INJURIES ON IMPACT WITH FURNISHINGS |
| 4,153,230 | 05/08/78 | Giacin | BABY BUMPERS |
| 4,416,251 | 11/22/83 | Rachels, Sr. | THERMOSHIELD |
| 4,527,540 | 07/09/85 | Ryan, et al. | CHILDREN'S SAFETY SHIELD FOR APPLIANCES |

Reece and Nicholas are relevant only in the sense that they teach mechanisms for anchoring against an upright support, Reece being used in connection with a fireplace. Rachels, Sr., and Ryan, et al., are only remotely relevant in that they both have mechanisms for protecting against heat-related dangers. Otherwise, each of those four inventions are dissimilar to the present invention both functionally and structurally.

Cahill and Giacin both relate to protection of persons, particularly the young, against the dangers of sharp-edged objects. They are directed toward furniture guards. The structure of the hearth guard is different from what is taught by these two patents.

Applicants are also aware that crib liners—which are foam pads tied to the upright bars of baby cribs to protect the child against bumps—have been in use for many years.

Applicants are unaware of any prior art that accomplishes the objects of the present invention. Consequently, a need exists for a safety article which will result in decreased injuries suffered as the result of falling onto the edge of a hearth.

OBJECTS OF THE INVENTION

The principal object of the present invention is to provide a hearth guard that protects against injuries suffered as the result of falling onto the edge of a hearth.

Another object of the invention is to provide a hearth guard that may be custom fit to a variety of hearth shapes and sizes.

Another object of the invention is to provide a hearth guard that is easily removable from the hearth, but that is durable.

Another object of the invention is to provide a hearth guard that is washable.

Yet another object of the invention is to provide a hearth guard that is decorative and pleasing to the eye.

SUMMARY OF THE INVENTION

The present invention is an innovative safety device for use with sharp-cornered structures, which overcomes the problems and satisfies the needs previously considered. The invented hearth guard protects against injuries suffered as the result of falling onto the edge of a structure, such as a raised hearth, by providing a cushioned surface surrounding the edge of the hearth. It allows for customized fitting of a variety of hearths and is also durable, as well as washable and decorative.

In summary, the invention encompasses a safety article including a filling substance, such as cotton, kapok, or other similar cushioning material; a cover encasing the filling substance, such as cloth; means for fitting the cover to the hearth; and means for securing the cover to the hearth.

DESCRIPTION OF THE PREFERRED EMBODIMENTS

Figure 1:
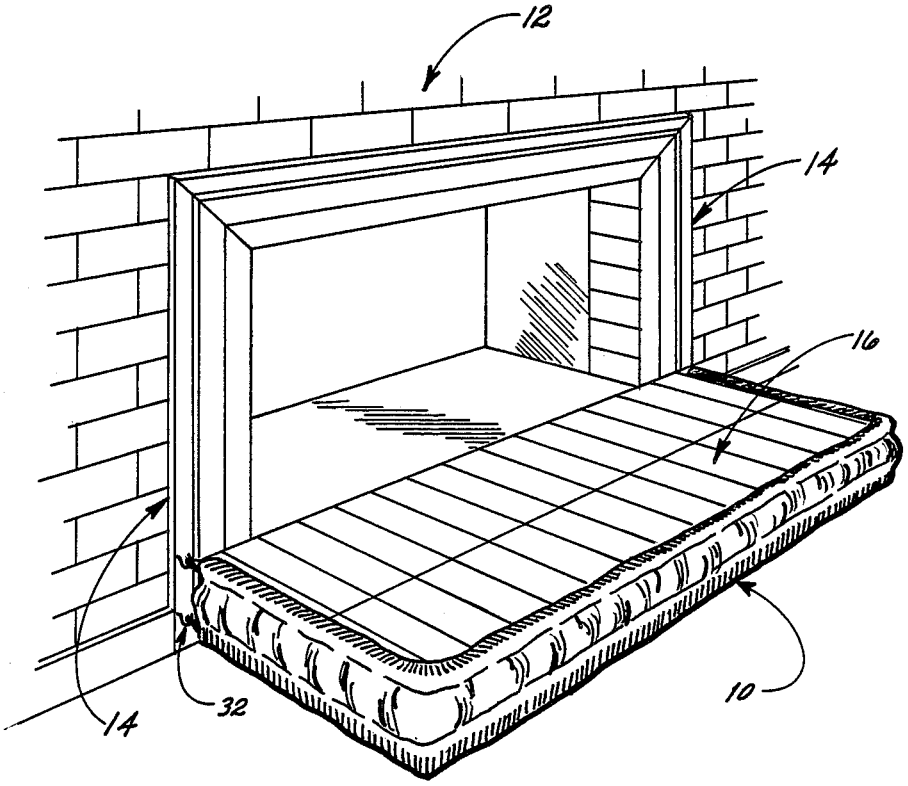
FIG. 1 is an isometric view of the invention in use on a hearth.
Figure 2:
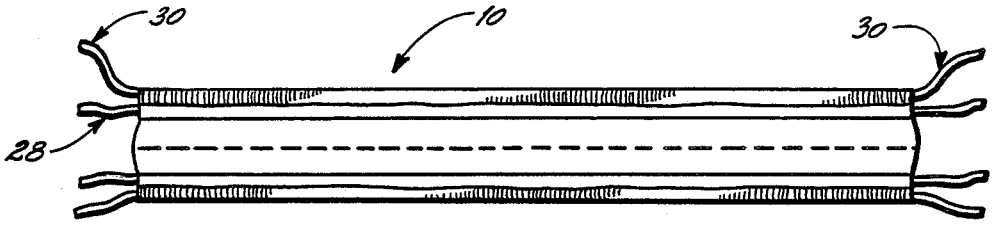
FIG. 2 is a front perspective view of the invention showing exterior padding, drawstrings, tie strings, and seams.
Figure 3:
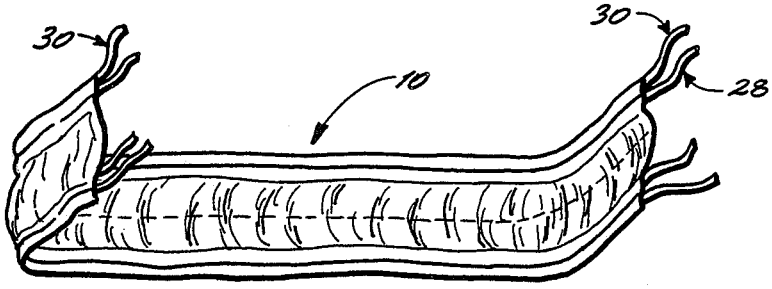
FIG. 3 is an isometric view of the invention showing exterior padding, drawstrings, tie strings, and seams.
Figure 4:
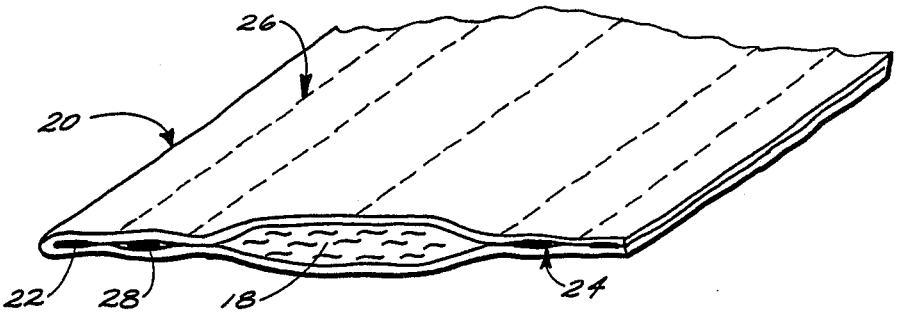
FIG. 4 is a cross-sectional view of the invention showing interior padding, seams, drawstrings, elastic bands, and openings for drawstrings and elastic bands.
Figure 5:
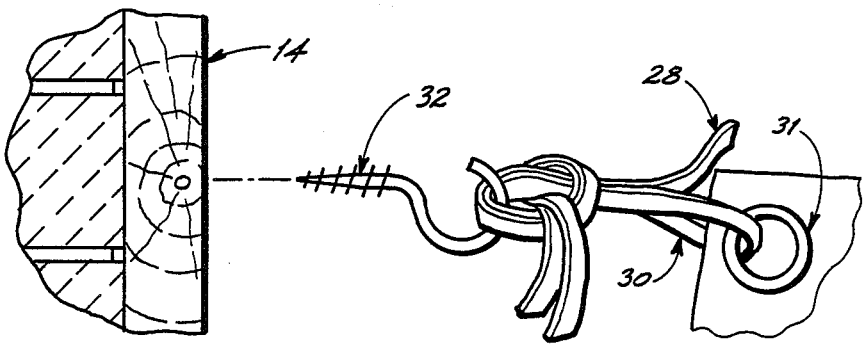
FIG. 5 is side view of a means for affixing connecting mechanisms (e.g., one end of a drawstring and one end of a tie string) to an anchoring mechanism, such as a hook.

Referring now to the drawings, and more particularly, to FIG. 1, there is shown a hearth guard, generally designated 10, which comprises the preferred embodiment of the present invention.

The invented hearth guard is shown in use with a fireplace 12, having upstanding sides 14. Generally, a fireplace is situated in the wall of a room for building a fire therein, although free standing fireplaces are also becoming more common. A hearth 16 is usually a raised floor, made of refractory material, situated in front of a fireplace. The main purpose of a hearth is to provide a safe area onto which sparks or other debris from a fire may fall.

The hearth guard includes a plurality of flameproof cotton batting sheets 18. Alternatively, the filling may be made of foam padding, soft rubber, or some other cushioning material, provided it is flameproof, flame resistant, or flame retardant, and gives off non-toxic fumes when ignited or charred. A rectangular flameproof cloth 20 encases the plurality of flameproof cotton batting sheets. The preferred material is flameproof, although the material can be flame resistant or flame retardant. For example, the material can be treated with nonleachable flame retardant chemical, manufactured by Maxichem, Inc., of Charlotte, N.C.

Elastic bands 22 are encased within and affixed inside the cover, situated at and parallel to the top and bottom of the cover, within openings 24 defined by at least one seam 26. The elastic bands allow for fitting the cover to the hearth.

Drawstrings 28 are inserted longitudinally through the top and bottom of the cover, within openings defined by at least one seam. The drawstrings allow for securing the cover to the hearth. The elastic bands and drawstrings may use the same opening or may have separate openings. If separate openings are used, the openings may share a common seam.

At least one pair of tie strings 30 is used to secure the cover to the upstanding sides. For each pair of tie strings, one tie string is affixed to the edge of the cover, while the remaining tie string is affixed to the opposite edge of the cover. Each tie string extends outwardly from the edge of the cover. Means for affixing the tie string to the cover include sewing, pinning, tying (by inserting the tie string through a grommet 31 affixed to the cover, for example), or by some other bonding process. Connecting mechanisms other than tie strings can also be used to attach the cover to the anchoring mechanisms.

Hooks 32 are fastened or embedded into the upstanding sides for securing the drawstrings and the tie strings thereto. The upstanding side may be the wall or molding beside the hearth, or, alternatively, the hearth itself in the event of a free standing fireplace with no associated wall or molding. Anchoring mechanisms other than hooks can also be used to secure the hearth guard.

SUMMARY OF THE ACHIEVEMENTS OF THE OBJECTS OF THE INVENTION

From the foregoing, it is readily apparent that we have invented a device for protecting persons, particularly children, from catastrophic trauma from falling and striking a sharp-cornered structure.

It is to be understood that the foregoing description and specific embodiments are merely illustrative of the best mode of the invention and the principles thereof, and that various modifications and additions may be made to the device by those skilled in the art, without departing from the spirit and scope of this invention, which is therefore understood to be limited only by the scope of the appended claims.

We claim:

1. A hearth guard, comprising:

(a) a filling substance comprising a plurality of flameproof cotton batting sheets;

(b) a cover encasing said filling substance, said cover comprising a rectangular flameproof cloth;

(c) elastic bands encased within and affixed within said cover, situated at and parallel to the top and bottom of said cover, within openings defined by at least one seam;

(d) at least one pair of anchoring mechanisms; and (e) a pair of drawstrings, one of said drawstrings inserted longitudinally through the top of said cover, within an opening defined by at least one seam, the other of said drawstrings inserted longitudinally through the bottom of said cover, within an opening defined by at least one seam, said drawstrings being adapted for attachment to said anchoring mechanisms.

2. A hearth guard, comprising:

(a) a filling substance;

(b) a cover encasing the filling substance;

(c) means for fitting the cover to the hearth; and (d) means for securing the cover to the hearth, wherein the securing means includes:

(i) at least one pair of anchoring mechanisms; and (ii) means for attaching the cover to the anchoring mechanisms, wherein the attaching means includes:

(1) at least one pair of connecting mechanisms;

(2) means for affixing the connecting mechanisms to the cover, wherein the means for affixing the connecting mechanisms to the cover includes one or more pairs of grommets affixed to the cover, equal to the number of pairs of connecting mechanisms, and connected to each pair of connecting mechanisms, for facilitating attachment of connecting mechanisms to anchoring mechanisms; and (3) means for affixing the connecting mechanisms to the anchoring mechanisms.

3. The hearth guard as set forth in claim 2, wherein the filling substance comprises a plurality of flameproof cotton batting sheets.

4. The hearth guard as set forth in claim 2, wherein the cover encasing the filling comprises a rectangular flameproof cloth.

5. The hearth guard as set forth in claim 2, wherein the means for fitting the cover to the hearth comprises elastic bands encased within and affixed inside the cover, situated at and parallel to the top and bottom of the cover, within openings defined by at least one seam.

6. The hearth guard as set forth in claim 2, wherein the anchoring mechanisms comprise hooks.

7. The hearth guard as set forth in claim 2, wherein each member of a pair of anchoring mechanisms is embedded into opposite upstanding sides of a wall adjacent to the hearth.

8. The hearth guard as set forth in claim 2, wherein the connecting mechanisms comprise tie strings made of strips of cloth.

9. The hearth guard as set forth in claim 2, wherein the connecting mechanisms comprise strips of elastic.

10. The hearth guard as set forth in claim 2, wherein the means for attaching the cover to the anchoring mechanisms comprises drawstrings inserted longitudinally through the top and bottom of the cover, within openings defined by at least one seam.

11. The hearth guard as set forth in claim 2, wherein the means for affixing the connecting mechanisms to the cover includes each connecting mechanism bonded to the edge of the cover for facilitating attachment of connecting mechanisms to anchoring mechanisms.

* * * * *